US006986703B2

(12) United States Patent
Weber

(10) Patent No.: US 6,986,703 B2
(45) Date of Patent: Jan. 17, 2006

(54) APPARATUS FOR PROCESSING SUBSTANTIALLY PLANAR WORKPIECES

(76) Inventor: Georg Weber, Friesener Strasse 27, 96317 Kronach (DE)

( * ) Notice: Subject to any disclaimer, the term of this patent is extended or adjusted under 35 U.S.C. 154(b) by 26 days.

(21) Appl. No.: 10/670,972

(22) Filed: Sep. 25, 2003

(65) Prior Publication Data

US 2004/0058629 A1 Mar. 25, 2004

(30) Foreign Application Priority Data

Sep. 25, 2002 (DE) ..... 102 44 733

(51) Int. Cl.
*B24B 29/00* (2006.01)

(52) U.S. Cl. ..... 451/285; 451/287; 451/291

(58) Field of Classification Search ..... 451/285–289
See application file for complete search history.

(56) References Cited

U.S. PATENT DOCUMENTS 2,948,087 A 8/1960 Caton
4,476,601 A * 10/1984 Oka ..... 15/88.3
5,105,583 A 4/1992 Hammond et al.
5,846,122 A * 12/1998 Graebner et al. ..... 451/28
6,328,640 B1 * 12/2001 Jones et al. ..... 451/194
6,379,230 B1 * 4/2002 Hayashi et al. ..... 451/292
RE38,228 E * 8/2003 Hirose et al. ..... 451/56

FOREIGN PATENT DOCUMENTS

EP 0839608 B1 5/2001

* cited by examiner

*Primary Examiner*—M. Rachuba
(74) *Attorney, Agent, or Firm*—McCormick, Paulding & Huber LLP

(57) ABSTRACT

Described is an apparatus for the processing of substantially planar workpieces, which can be moved in a transport plane relatively to the apparatus. The apparatus contains at least one grinding head with a tool carrier rotatable around a carrier axis which is orthogonal with respect to the conveyor plane and with several grinding brushes containing a brush body and bristles attached thereto being mounted to the tool carrier so that they can be rotated individually around individual brush axes, the ends of the bristles of the very same grinding brush being arranged at various distances to the transport plane.

8 Claims, 3 Drawing Sheets

APPARATUS FOR PROCESSING SUBSTANTIALLY PLANAR WORKPIECES

CROSS-REFERENCE TO RELATED APPLICATIONS

This application is entitled to the benefit of German Patent Application No. 102 44 733.0 filed on Sep. 25, 2002.

FIELD OF INVENTION

The present invention concerns an apparatus for processing substantially planar workpieces, which workpieces are moveable in a transport plane relatively to the apparatus, the apparatus including at least one grinding head having a tool carrier rotatable around a carrier axis orthogonal to the transport plane, on which tool carrier a plurality of grinding brushes each including a brush body and bristles attached to said body are individually mounted so that they are each rotatable around an individual brush axis.

BACKGROUND OF THE INVENTION

One such apparatus is for example known from U.S. Pat. No. 5,105,583, in which a machine for the deburring of internal and external burrs of metal workpieces is shown, in which the workpieces are moved in a horizontal transport plane relatively to the deburring machine. The deburring machine includes a planetary grinding head with a planet carrier which rotates around a vertical carrier axis at low speed. Inside the planet carrier three planet gears are mounted rotatably around vertical axes, which rotate at high speeds when the planetary grinding head is driven. Brushes, whose bristles are engaged vertically against the surface of the workpiece, are attached to the planetary gears.

An apparatus of the afore-mentioned kind not only serves for deburring, but also for removing oxide layers from cutting areas, which oxide layers are formed e.g. during the cutting of metal sheet plate to size with the help of laser beams or during autogenous cutting. Since such burrs usually protrude vertically from the workpiece surface, they will be removed during processing of said surface, while the cuffing areas extend perpendicularly to said surface and require processing in a processing plane perpendicular to the workpiece surface processing plane.

In order to be able to process the workpiece simultaneously in said processing planes which are perpendicular to each other, the brushes, which in an apparatus of the afore-mentioned kind are generally engaged against the workpiece surface, have to be sufficiently soft and yielding to reach both the surface and the cutting areas of the workpiece. The thicker the metal sheet plate to be processed is, the softer the bristles of the grinding brushes need to be so as to cover the entire cutting area, respectively, generally speaking, the edges of a workpiece.

However, the bristles may not exhibit any desired degree of softness, since their abrasive effect might become too small. Since it has recently become possible to cut metal sheet plate of increasing thickness to size by means of a laser, it is no longer possible to perform comprehensive processing of the edges of a workpiece by means of a known apparatus of the afore-mentioned type with satisfactory efficiency.

In the above-mentioned U.S. Pat. No. 5,105,583 it is suggested not to arrange the carrier spindle in an exact vertical direction (and thus not orthogonally to the transport plane, at variance from the wording of the preamble), but to tilt its upper end somewhat in the workpiece feeding direction which results in a higher pressure being exercised on the front face of the workpiece, which in turn causes an increase in the abrasive effect on the workpiece front face, while the abrasive effect on the lateral edges does not increase and the abrasive effect on the workpiece rear face even decreases.

It is an object of the present invention to provide an apparatus of the afore-mentioned kind which allows comprehensive and efficient processing of the edges of a workpiece also for comparatively thick workpieces.

This object is solved by an apparatus according to the present invention. This enables the bristles to process different portions of the workpiece edges in accordance with their respective distance to the transport plane. Thus, by selecting the distances of the bristles from the transport plane in a suitable manner, the entire width of the workpiece edges (i.e. the entire thickness of the workpiece) can be processed, while there is no need for using especially soft bristles. Thus, it is possible to achieve a far greater abrasive effect with the apparatus according to the present invention than with known apparatus.

Varying distances between the ends of the bristles and the transport plane can be reached in different ways. In a preferred embodiment of the invention the bristles on the individual grinding brushes differ in length. In another preferred embodiment the brush bodies are tilted with respect to the transport plane. In both cases, a good abrasive effect on the entire width of the workpiece edges is achieved, while the respective distances between the ends of the single bristles and the transport plane do not change during the rotation of the grinding brush. Since the bristles are arranged at different distances to the transport plane, however, they wear off unevenly.

In an improved embodiment, the brush bodies are tilted with respect to the transport plane, while the brush axes extend in an orthogonal direction with respect to the brush bodies. This means that the distance between each single bristle and the transport plane changes as the brush rotates around its brush axis. The brush itself can be rotationally symmetric with respect to the brush axis and thus wears off evenly.

Preferably, the distances between the ends of the bristles and the transport plane differ by up to 1 to 2 cm. In an advantageous embodiment the apparatus includes several planetary heads which are arranged in two rows extending transversely with respect to the workpiece transport direction with the rows being arranged one behind the other in the workpiece feed direction and with the two rows of planetary heads being offset towards each other transversely with respect to the workpiece transport direction such that the planetary heads of one row—when viewed in the workpiece transport direction—close the gaps between the planetary heads of the other row. By using such an arrangement also big workpieces, and in particular broad metal sheets, can be processed.

A further improvement can be achieved by using different types of bristles. Thus the bristles of at least one of the grinding brushes can differ from the bristles of the other grinding brushes in their material characteristics, structure, texture, hardness, thickness and/or trimming length. The different types of bristles may necessitate a different infeed of the grinding brushes in the direction of the workpiece in order to reach the desired results and may moreover exhibit different wear behaviour during their useful life. For this reason it is advantageous if the infeed of at least some of the grinding brushes can be regulated individually. It is also possible to control the infeed of sets of grinding brushes of the same type, for which purpose use may be made of a support element for grinding brushes of the same type which is centrally adjustable. In an alternative solution all grinding brushes are arranged within a common support element such that they can be axially adjusted with sets of like grinding brushes being adjustable via a common operating device.

BRIEF DESCRIPTION OF THE DRAWINGS

Further features and advantages of the invention will be apparent from the following description in which the solution according to the present invention is explained in more detail by way of exemplary embodiments and with reference to the accompanying drawings. The drawings are.

DETAILED DESCRIPTION OF THE PREFERRED EMBODIMENTS

Figure 1:
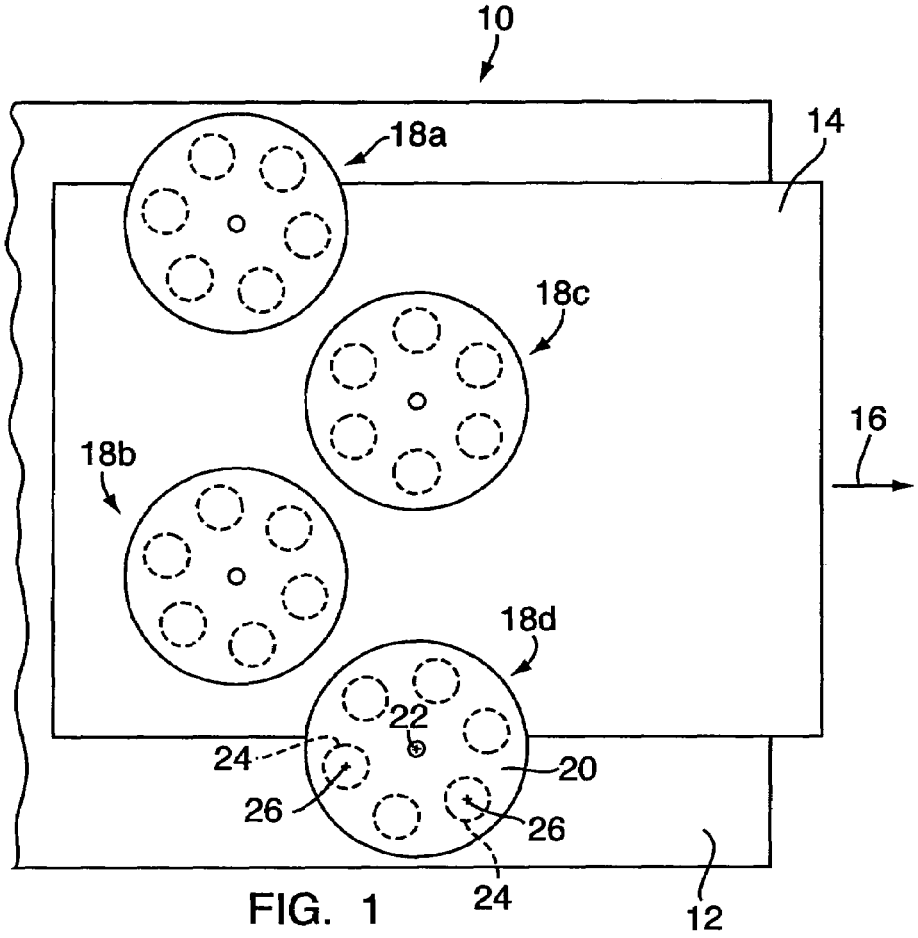
FIG. 1 a plan view of an apparatus according to one embodiment of the present invention, FIG. 2 a side view of the apparatus of FIG. 1, FIG. 3 a schematic sectional view of a metal sheet plate whose edge is processed by means of a grinding brush of a known apparatus, FIG. 4 a schematic sectional view of a metal sheet plate whose edge is processed by means of a grinding brush of an apparatus according to one embodiment of the present invention, FIG. 5 a schematic sectional view of a metal sheet plate whose edge is processed by means of a grinding brush of an apparatus according to a further embodiment of the present invention, FIG. 6. a semi-schematic partial sectional view through a portion of the planetary grinding head containing the axis and a grinding brush according to a further embodiment of the invention and FIG. 7. a partially schematic plan view of the portion of the planetary grinding head shown in FIG. 6.

FIG. 1 shows a plan view of an apparatus 10 for the processing of substantially planar workpieces and particularly of metal sheet plates. The apparatus 10 contains a conveyor belt 12, which conveys a sheet steel plate 14 lying thereon in a horizontal transport plane. The feed direction of the sheet steel plate 14 is indicated by an arrow 16.

The apparatus 10 includes four similar planetary grinding heads 18*a,* 18*b,* 18*c* and 18*d,* out of which grinding head 18*d* will be explained in the following by way of example. The grinding head 18*d* contains a planet carrier 20 rotatable around a vertical carrier axis 22. Within the planet carrier 20 grinding brushes 24 are mounted rotatably around vertical brush axes 26. The grinding brushes 26 are coupled to planet gears (not shown) which drive them in a known manner at high speeds, while the planet carrier 20 rotates at a comparatively low speed.

The planetary grinding heads 18*a* and 18*b* are arranged in a first row extending transversely to the feed direction 16, while the planetary grinding heads 18*c* and 18*d* are arranged in a second row extending transversely to the feed direction 16 with the first and second rows being offset to each other in such a manner that the planetary grinding head 18*c*—when viewed in the feed direction 16—closes the gap between the planetary grinding heads 18*a* and 18*b* resp. the planetary grinding head 18*b* closes the gap between the planetary grinding heads 18*c* and 18*d*. This arrangement allows uniform processing of the sheet steel plate 14 over its entire width.

Figure 2:
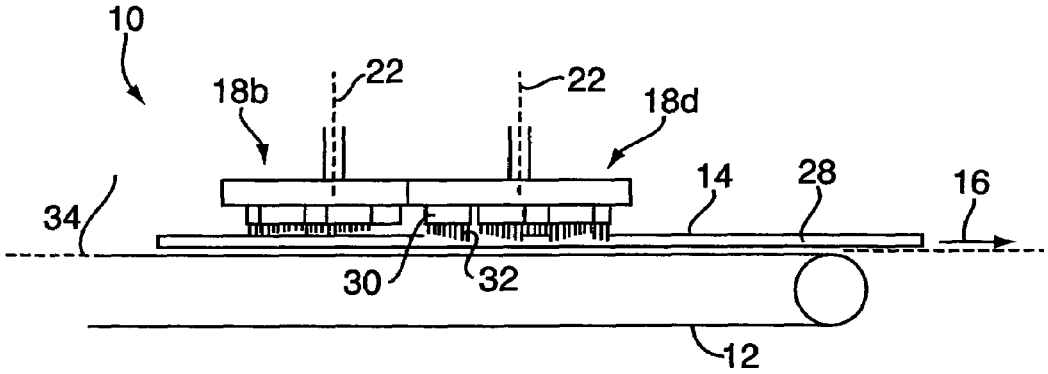

FIG. 2 shows a side view of the apparatus 10 of FIG. 1. In this Figure, the right lateral edge of the sheet steel plate 14 when viewed in the feed direction 16 (i.e. the lower lateral edge as shown in FIG. 1) is depicted. Moreover, in FIG. 2 the planetary grinding head 18*d* and the planetary grinding head 18*b,* which is partially concealed by the former, are shown.

As can be seen in FIG. 2, the brushes 24 include brush bodies 30 and bristles 32 attached thereto. In accordance with one embodiment of the invention the brushes 32 in FIG. 2 are of different lengths and their ends therefore are spaced at different distances to the transport plane indicated by means of dashed lines 34 in FIG. 2. While the brushes 24 of the grinding head 18*b* shown in FIGS. 1 and 2 only process the surface of the sheet steel plate 14, the brushes 24 of the grinding head 18*d* also process the lateral edge 28.

Figure 3:
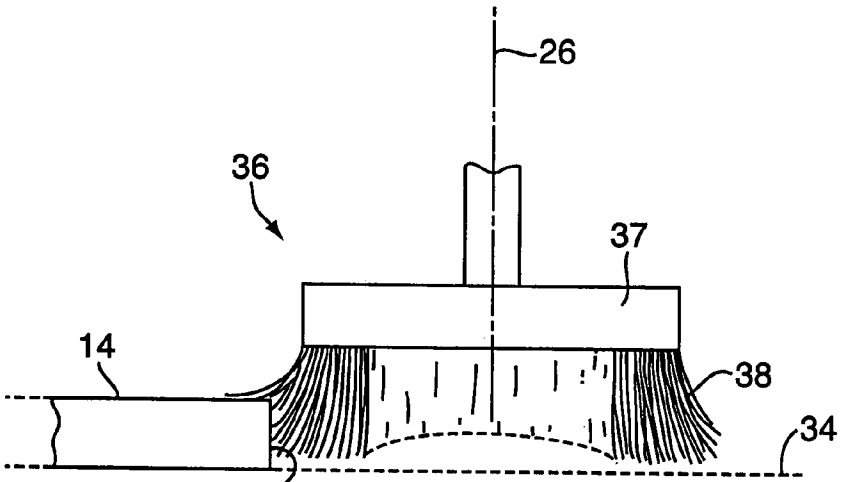

In the following, the processing of the lateral edge 28 by means of a known apparatus and by means of various embodiments of the invention, respectively, will be described with reference to FIGS. 3 to 6. In FIG. 3 a schematic sectional view of a known grinding brush 36 including a brush body 37 and bristles 38 is shown. As depicted schematically in FIG. 3, the brush 36 is a pot brush in which the ends of the bristles 38 are spaced at a uniform distance to the transport plane 34. When the brush 36 is rotated around its brush axis 26 as shown in FIG. 3, the bristles 38 are bent outwards due to centrifugal forces and thus make contact with the lateral edge 18 of the sheet steel plate 14 over its entire width (i.e. over the entire thickness of the sheet steel plate 14). To achieve this, however, the bristles 38 have to be relatively soft, which impairs their machining qualities.

Figure 4:
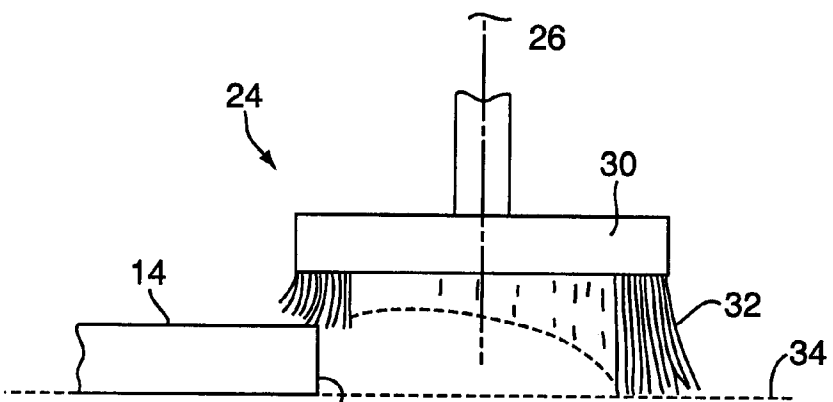

FIG. 4 shows a sectional view which is basically identical to the one shown in FIG. 3, except for the fact that in FIG. 4 use is made of the grinding brush 24 with bristles 32 of varying lengths already depicted in FIG. 2. The bristles 32 of the grinding brush 24 are markedly harder than the bristles 38 of the known grinding brush shown in FIG. 3 and thus, due to their low flexibility, each bristle can only process a certain portion of the lateral edge 28 depending on the distance between the end of said bristle and the transport plane 34. However, since the bristles 32 are of varying lengths and their ends are thus spaced at various distances to the transport plane 34, all or lateral edge 18 is processed over the entire thickness of the sheet steel plate 14.

Figure 5:
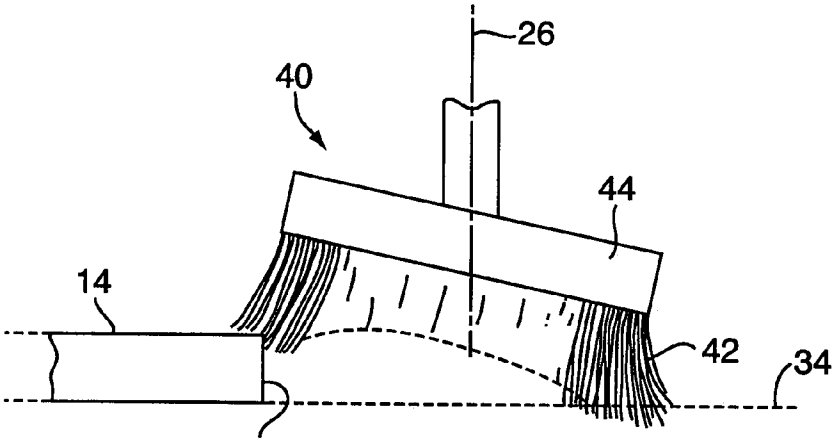

Similarly to FIGS. 3 and 4, FIG. 5 shows an arrangement for a grinding brush 40 according to an alternative embodiment of the invention. In the case of the grinding brush 40 the bristles 42 are all of uniform length. However the corresponding brush body 44 is tilted with respect to the transport plane 34, while the brush axis 26 remains vertical. Thus, despite their uniform length, the ends of the bristles 42 are spaced at different distances to the transport plane 34 and it is possible to process the lateral edge 18 over the entire thickness of the sheet steel plate 14 without using particularly soft bristles 42. In the arrangement of FIG. 5 the grinding body 44 performs a tumbling movement when the grinding brush 40 rotates around its axis 26.

The distance between the ends of each bristle and the transport plane 34 remains unchanged during the rotation of the brush both in the case of the grinding brush 24 of FIG. 4 and in the case of the grinding brush 40 of FIG. 5. Since the wear the bristles are subjected to changes depending on their distance from the transport plane, the bristles 32 of the grinding brush 24 and the bristles 42 of the grinding brush 40, respectively, will wear off unevenly. In the case of the grinding brush 24 of FIG. 4 the uneven wear is enhanced further by the different lengths of the bristles 32.

In the embodiments shown in FIGS. 4 and 5 the distances between the ends of the bristles of one single grinding brush and the transport plane 34 differ by up to 1 to 2 cm, i.e. the bristles which are spaced at the greatest distance from the transport plane 34 are spaced to said plane at a distance which is 1 to 2 cm larger than that of the bristles arranged closest to it. Such a distance range allows for the removal of oxide layers from lateral edges of metal sheet plates with a thickness of up to at least 2 cm with the use of the disclosed apparatus while the bristles do not need to be particularly soft.

Figure 6:
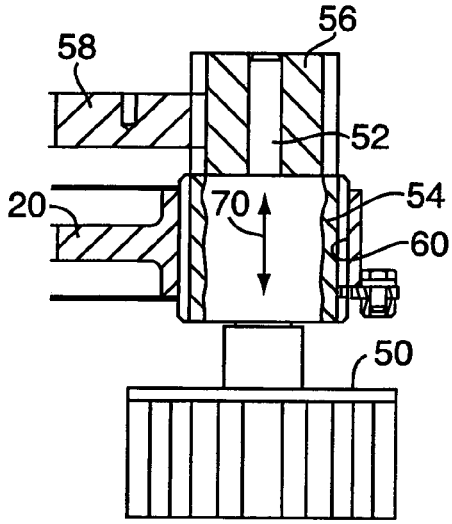

The sectional view of FIG. 6 shows a planet carrier 20 and a grinding brush 26 which is coupled to a shaft 52. Together with this shaft 52 the grinding brush 26 is mounted in a nut 54 in such a way that it is freely rotatable, but inhibited from performing an axial sliding movement. On the free end of the shaft 52 protruding from the nut 54 a pinion gear 56 is mounted in a torque proof manner, which intermeshes with a sun gear 58 of the planetary drive.

Figure 7:
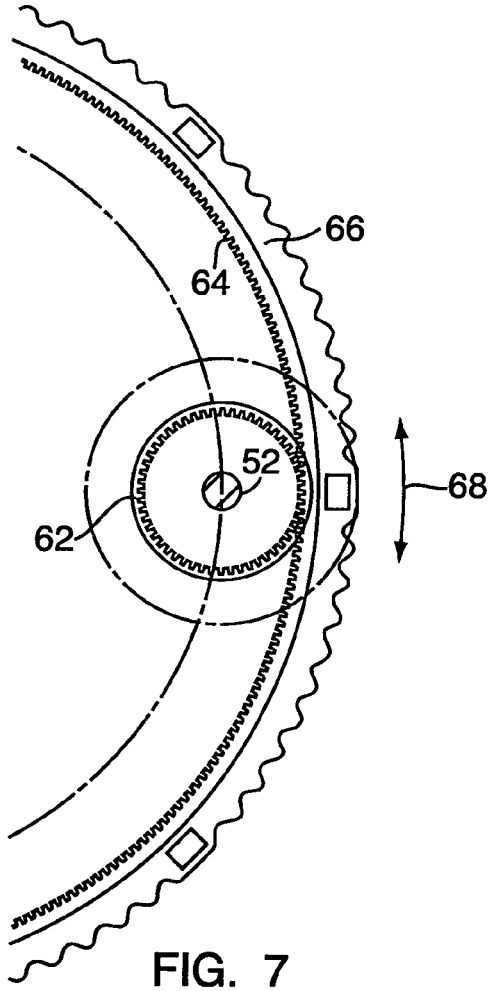

On an axial portion of the periphery of the nut 54 a thread is formed by means of which the nut is screwed into a corresponding threaded hole 60 of the planet carrier 20. On the remaining portion of the periphery of the nut 54 a toothing 62 is formed which is engaged with an adjusting collar 66 mounted on the planet carrier 20 coaxially to the latter and provided with internal teeth 64. By turning the adjusting collar 66 in the direction of the double arrow 68 of FIG. 7 the nut 54 can be adjusted within the planet carrier 20 in the direction of the double arrow 70 of FIG. 6 parallel to the axis of the planet carrier 20. The adjusting collar 66 can engage the nuts 54 of a plurality of grinding brushes 26 in order to adjust several grinding brushes 26 with respect to the planet carrier 20 at the same time, while other grinding brushes may be arranged on the planet carrier in such a way that they are not adjusted by means of the adjusting collar 66. This arrangement allows for moving a set of grinding brushes, which e.g. are provided with a special type of bristles, to a distance relatively to the workpiece that differs from that of the remaining grinding brushes mounted on the same planet carrier.

REFERENCE CHARACTER LIST

10—apparatus for processing planar workpieces
12—conveyor belt
14—sheet steel plate
16—feed direction
18*a*—planetary grinding head
18*b*—planetary grinding head
18*c*—planetary grinding head
18*d*—planetary grinding head
20—planet carrier
22—carrier axis
24—grinding brush
26—brush axis
28—lateral edge
30—brush body
32—bristles
34—transport plane
36—grinding brush
37—brush body
38—bristles
40—grinding brush
42—bristles
44—brush body
46—grinding brush
48—bristles
50—brush body
52—shaft
54—nut
56—pinion
58—sun gear
60—threaded bore
62—toothing
64—internal teeth
66—adjusting collar
68—double arrow
70—double arrow

What is claimed is:

1. An apparatus (10) for the processing of substantially planar workpieces (14), which can be moved in a transport plane (34) relatively to the apparatus (10), the apparatus containing at least one grinding head (18*a*, 18*b*, 18*c*, 18*d*) with a tool carrier (20) rotatable around a carrier axis (22) which is orthogonal with respect to the transport plane (34) and with several grinding brushes (24, 40, 46) drivable by a planetary gear drive and containing a brush body (30, 44, 50) and bristles attached thereto (32, 42, 48) being mounted to the tool carrier so that they can be rotated individually around their individual brush axes (26) which are orthogonal with respect to the transport plane (34), wherein the ends of the bristles (32, 42, 48) of each single grinding brush (24, 40, 46) are arranged at various distances to the transport plane (34).

2. An apparatus (10) according to claim 1, further characterized in that the bristles (32) of each single grinding brush (24) differ in length.

3. An apparatus (10) according to claim 1 or 2, further characterized in that the brush bodies (44) are tilted with respect to the transport plane (34).

4. An apparatus (10) according to claim 1, further characterized in that the distances between the ends of the bristles and the transport plane (34) differ by 1 to 2 cm.

5. An apparatus (10) according to claim 1, further characterized in that the apparatus contains several grinding heads (18*a*, 18*b*, 18*c*, 18*d*) which are arranged in two rows extending transversely to the transport direction of the workpiece (14), which rows are arranged one behind the other in the feed direction (16) of the workpiece (14) with the two rows of grinding heads being offset to each other in a direction transversely to the transport direction (16) of the workpieces (14) in such a manner that the grinding heads (18*b* resp. 18*c*) of one row—when viewed in the transport direction (16) of the workpiece (14)—close the gaps between the grinding heads (18*c*, 18*d* resp. 18*a*, 18*b*).

6. An apparatus according to claim 1, further characterized in that the bristles of at least one of the grinding brushes differ from the bristles of the other grinding brushes in at least one of the their material characteristics, structure, texture, hardness, thickness and trimming length.

7. An apparatus according to claim 1, further characterized in that the infeed of at least some of the grinding brushes can be adjusted individually.

8. An apparatus according to claim 1, further characterized in that the infeed can be adjusted for sets of grinding brushes of the same type.

* * * * *